United States Patent [19]

Bredow

[11] 4,452,115

[45] Jun. 5, 1984

[54] MACHINE FOR TREATING PLATE-SHAPED WORKPIECES ESPECIALLY A CUTTING PRESS

[75] Inventor: Walter Bredow, Alfeld, Fed. Rep. of Germany

[73] Assignee: C. Behrens AG, Alfeld, Fed. Rep. of Germany

[21] Appl. No.: 405,336

[22] Filed: Aug. 5, 1982

[30] Foreign Application Priority Data

Sep. 5, 1981 [DE] Fed. Rep. of Germany ..... 3135266

[51] Int. Cl.[3] ..... B26D 7/18

[52] U.S. Cl. ..... 83/157; 83/71; 83/552

[58] Field of Search ..... 83/157, 71, 552, 155, 83/155.1, 109, 147

[56] References Cited

U.S. PATENT DOCUMENTS

| | | | |
|---|---|---|---|
| 3,603,187 | 9/1971 | Bredow | 83/71 |
| 3,691,887 | 9/1972 | Roch | 83/71 |
| 3,717,061 | 2/1973 | Daniels | 83/552 |
| 3,815,403 | 6/1974 | Daniels | 83/71 |
| 4,080,855 | 3/1978 | De George et al. | 83/71 |
| 4,162,641 | 7/1979 | Stubbing | 83/71 |
| 4,343,210 | 8/1982 | Kuroyone | 83/71 |
| 4,372,183 | 2/1973 | Lehtinen | 83/71 |

*Primary Examiner*—Donald R. Schran

*Attorney, Agent, or Firm*—Michael J. Striker

[57] ABSTRACT

A cutting press for treating plate-shaped workpieces includes a coordinate table and a stationary support which surrounds the working area of a cutting tool. A central workpiece support is mounted on the coordinate table for movement in lateral guides of the latter toward and away from the stationary support independently of the movement of the coordinate table, so as to open and close a discharge opening between itself and the stationary support. The central workpieces support includes a plurality of elongated support elements extending transversely of the direction of movement of the central workpiece support in the lateral guides and articulately connected in series to one another. Driving units are provided which act on the ends of the movable central workpiece support for moving the same relative to the coordinate table. A device for expelling cut-out parts of the original workpiece from the latter into the discharge opening is mounted above the area of the discharge opening for movement between a lifted position in which the expelling device is remote from the central workpiece support and a lowered position in which it acts in the downward direction on the workpiece. The expelling device includes a pressure plate and a plurality of elastic elements mounted on the lower side of the pressure plate and acting on the workpiece in the lowered position.

14 Claims, 8 Drawing Figures

16
17
6
8
8
4
4'
17a
1
7
1'
14
3
7a
7'
19
7a
20
K
21
10
21
5
5'
12
13
X
Y 16
17a
17
6
8
4
11
16
30
31
35
32
33
34
3
9
14
7
7
40
7a
19
7
7a
15
12
K
21
5

16
30
31
32
17a
17
6
18
33
34
8
4
41
7
40
7a
19
3
K
9
14
11
12
16
7a
7
15
21
5

14
33
7
32
41
34
7
40

34
34'
32
41
34'
33
34
40

6
63
61
60
62
65
14
66
67

6
9
63
61
60
68
14
62
65
64
7a
66
67
69

16
6
8
17
4
11
16
52
56
54
17a
58
9
57
14
53
55
50
51
7

MACHINE FOR TREATING PLATE-SHAPED WORKPIECES ESPECIALLY A CUTTING PRESS,

BACKGROUND OF THE INVENTION

The present invention relates to machines for handling, working or otherwise treating plate-shaped workpieces in general, and more particularly to a plate-shaped workpieces cutting press.

There are already known and in widespread use various constructions of plate-shaped workpieces treating machines and cutting presses, among them machines equipped with a movement controlled coordinate table for the positioning of the respective workpiece and a stationary support for the workpiece, such support surrounding the working area of a tool, such as a cutting tool. In some machine constructions of this type, a central workpiece support consisting of articulately interconnected support elements is arranged frontwardly of the tool working area, this central workpiece support being mounted and guided on lateral guides or guide rails of the coordinate table for movement relative to the latter.

In many cutting presses currently in use, the coordinate table is numerically controlled as to its position and movement relative to the cutting tool working area. These cutting presses may be constructed either as machines with a tool storage arrangement in the form of an indexible turret or disk, or as machines equipped with a single cutting tool which is periodically manually replaced by a different cutting tool, or as machines equipped with a storage arrangement for the cutting tools from which the cutting tools are withdrawn as needed and transported into their working positions with the aid of mechanical intermediate members constituting a transporting arrangement for the tools. In any event, it is the function of the coordinate table to accurately position the plate-shaped workpiece, usually a sheet metal workpiece, to be perforated, cut out or subdivided, relative to the respective cutting tool in its working position. This means that the workpiece must be so moved that the cutting tool becomes effective for acting on the respective workpiece in exactly the desired or predetermined relative position thereto.

The coordinate table conducts movements, on the one hand, in directions toward and away from the cutting tool or arrangement, that is, in the direction of the so-called y-axis, or, on the other hand, in directions transverse to the aforementioned directions, that is, along the so-called x-axis. The more exacting are the requirements for the accuracy of the hole pattern to be produced, the better must the workpiece be supported during the movement thereof with the coordinate table and during the individual cutting operations. To achieve this required supporting action for the workpiece, the conventional cutting presses of this type are ordinarily equipped with, on the one hand, a stationary support surrounding the cutting tool or the working area thereof, and on the other hand, a central workpiece support which is situated frontwardly of the cutting tool, is arranged between lateral workpiece resting members or rails which are movable in dependence on the movement of the coordinate table along the y-axis, and consists of a plurality of adjacent elongated support elements which extend in the direction of the x-axis and are articulately connected to one another. Thus, the central workpiece support has a louver-like or blind-like construction.

In the conventional cutting presses of this type, the end of the central workpiece support which is closest to the cutting tool working area, that is, the corresponding last support element, is rigidly connected with the stationary support at the working area of the cutting tool. In this manner, there is obtained a completely closed support surface at the region of the cutting tool.

This large-area support of the workpiece has for its consequence that the operating personnel can reach the area of the central point of the cutting tool only with a substantial degree of difficulty. So long as no pieces need be removed during the working of the respective workpiece or sheet metal object, whether such pieces be resultant waste pieces or cut-out pieces, or whether the plate-shaped workpiece which simultaneously includes a plurality of finished pieces is to be subdivided in the cutting press into such individual finished pieces, the operation of the cutting press is not significantly hampered by the removal of such pieces or parts. The need for removal of the waste pieces or parts can be circumvented by the subdivision thereof by using relatively large cutting tools into relatively small pieces which can then be removed from the tool working area through a discharge chute, that is provided under all circumstances, in the working position. However, such a subdivision entails the use of the corresponding cutting tools for the performance of such a subdivision, and hence an additional operational phase of the cutting press.

When such a subdivision cannot be accomplished, or when the cutting press is equipped with a laser cutting device or a combination of such a laser cutting device with mechanical cutting tools, it is unavoidable when such large-area pieces are being cut out, that these waste pieces or usable pieces which come into being must be removed by hand. This constitutes a very time-consuming operation and, above all, leads to an interrpution of the controlled operational cycle of the cutting press. This, of course, is very disadvantageous particularly since the cutting press cannot be used to the full extent of its capacity.

SUMMARY OF THE INVENTION

Accordingly, it is a general object of the present invention to avoid the disadvantages of the prior art.

More particularly, it is an object of the present invention to develop a plate-shaped workpieces treating machine, especially a cutting press, which does not possess the disadvantages of the conventional machines of this type.

A further object of the present invention is so to construct the machine of the type here under consideration that large-area pieces of the original workpiece, be they large-area useful pieces, finished pieces, or waste pieces, can be automatically removed therefrom without interrupting the operation of the cutting press for any extended period of time.

It is still another object of the present invention to so design the machine of the above type as to substantially maintain its construction and mode of operation as it was conventionally, but with the additional equipment capable of removing even large-area pieces of the original workpiece therefrom.

A concomitant object of the present invention is to provide a machine of the above type and equipped in accordance with the present invention, which is simple in construction, inexpensive to manufacture, easy to use, and reliable in operation nevertheless.

Yet another object of the present invention is to devise a machine of the above type in which the automatic operation control is only slightly augmented and yet the need for manual removal of workpieces therefrom is overcome.

In pursuance of these objects and others which will become apparent hereafter, one feature of the present invention resides, in a machine for threating plate-shaped workpieces, especially in a cutting press, equipped with at least one tool operating within a predetermined area, a stationary support for the workpiece at such predetermined area, and a coordinate table movable toward and away from the predetermined area and operative for supporting the workpiece thereon for joint movement therewith, in a combination comprising a central support for the workpiece; and means for mounting the central support on the coordinate table for movement relative thereto and independently thereof toward and away from the predetermined area between a retracted position in which a discharge opening is defined between the same and the stationary support, and an extended position in which the discharge opening is substantially closed. It is particularly advantageous when the mounting means for the central workpiece support includes a pair of lateral guide rails spaced from one another transversely of the direction of movement of the coordinate table toward and away from the predetermined area and connected to the coordinate table for joint movement therewith. Advantageously, the central workpiece support includes a plurality of substantially louver-shaped elements extending transversely of the aforementioned direction, supported on the guide rails, and pivotally connected in series to one another.

As a result of the above-discussed construction, it is achieved that, after a corresponding advancement movement of the treated workpiece beyond the end of the stationary support, there can be opened below the workpiece portion situated frontwardly of the stationary support a discharge opening independently of the otherwise assumed position of the coordinate table by causing the central workpiece support to move from its extended position toward its retracted position, so that the respective waste cut-out or the cut-out useful piece can be discharged downwadly through this now open discharge opening. This occurs exclusively by the machine operation, so that the otherwise existing need for the operating presonnel to reach into the operating area of the cutting tool and to manipulate the loose pieces of the original workpiece is completely rendered unnecessary. The arrangement for controlling the retraction and extension movement of the central workpiece support can be so incorporated into and integrated with the control arrangement of the cutting press and the function thereof that no siginificant additional time expenditure is needed for the removal of the cut-out parts. In any event, any interruption of the operation of the cutting press is avoided completely.

During the retraction and extension movement of the central workpiece support, the latter is supported on the lateral guides or guide rails which are provided therefor in any event, so that no additional constructional measures need be taken in this respect. When the presence of the discharge opening is disregarded, particularly since it opens only below the part of the workpiece which is to be removed to begin with, the workpiece, or the still intact remainder thereof, continues to be properly supported at least on the coordinate table or the central workpiece support mounted on the latter. After the conclusion of the discharging or removing operation, the discharge opening can again be closed by the independent extension movement of the central workpiece support, whereafter the original situation is restored and the coordinate table can perform its further positioning movements.

A particularly advantageous construction of this cutting press, both in terms of structure and function, as far as the retraction and extension movement of the central workpiece support is concerned is obtained when, in accordance with a further concept of the present invention, there is provided means for moving the central workpiece support relative to the coordinate table between the aforementioned extended and retracted positions, such moving means including at least one driving unit mounted on one of the coordinate table and the stationary support and acting on one end of the central workpiece support as considered in the aforementioned direction. In this context, it is especially advantageous when the moving means further includes at least one additional driving unit mounted on the other of the stationary support and the coordinate table and acting on the other end portion of the central workpiece support as considered in the same direction.

When such moving means is provided and constructed in the above-discussed manner, there is obtained a possibility of automatic retraction and extension movement of the central workpiece support in a manner which is especially simple and particularly suited to the position and directions of movement of the central workpiece support. It is particularly advantageous in this connection, in accordance with a further facet of the present invention, when the driving units, or at least one of them, are constructed as cylinder-and-piston units operatable by a pressurized fluid, such as, for instance, hydraulically or pneumatically operated positioning units, which are connected to the respective ends of the central workpiece support, that is, to the last elements of the latter which are closest thereto.

It is particularly advantageous to arrange transportation means, especially a conveyor belt, underneath the area of the discharge opening which can be selectively opened by the movement of the central workpiece support toward its retracted position, such transportation means then serving for transporting away any objects falling thereon, especially the parts of the original workpiece which have been released from the latter and have fallen through the discharge opening. In this manner, the respective cut-out parts of the workpiece can be transported away in a suitable manner, for instance, to an accumulating receptacle or bin arranged downstream and in continuation of the transportation means.

Experience has shown that under certain circumstances, for instance, when the parts of the workpiece have been cut in a special cutting operation and especially when such parts have complicated shapes, or when a laser cutting device has been used instead of a mechanical cutting device for severing the parts which have been severed from the remainder of the workpiece and which are to be discharged through the discharge opening, in the latter instance because of the extremely narrow width of the gap between the cut-out part and the remainder of the workpiece, the gravitational forces alone are insufficient to cause the cut-out part of the original workpiece to fall into and through the discharge opening which has been opened below the same during the retraction movement of the central workpiece support, with the required degree of security. So, for instance, when such cut-out parts of the original workpiece consist of circles and straight lines extending at various angles relative to one another, it will sometimes happen that jamming or edging thereof will occur, when the center of gravity of the part does not coincide with the linear center of the part. In order to assure the discharge of such cut-out parts through the discharge opening even under such circumstances, it is proposed in accordance with a further facet of the present invention, for use with a workpiece including at least two separate parts one of which is retained within the other, to provide means for expelling the one part into the discharge opening, such expelling means including at least one elastic element movable between a lifted position remote from the workpiece and a lowered position in which it acts on the one part of the workpiece in the downward direction. In most instances, a plurality of commonly movable elastic elements is being used instead of a single one. In this manner, it is assured, by using a simple auxiliary arrangement, that even the most complicated workpiece sections or parts are securely expelled from the remainder of the workpiece and into the discharge opening which has been released during the retraction movement of the central workpiece support, even when the gap between the part to be expelled and the remainder of the workpiece is minute. Herein, the elastic element itself exerts, or the elastic elements themselves exert, the necessary pressing force on the part to be expelled after the corresponding lowering thereof, due to its or their elasticity. It is especially advantageous when the expelling means includes a pressure plate connected to the elastic element or elements for movement with the same between the raised and lowered positions and situated above the elastic element or elements. The respective elastic element may be of an elastic material, such as, for instance, rubber, foamed rubber or hard rubber, or of other elastomeric materials having degrees of hardness corresponding to the respective application. In an alternative, the elastic elements may include rigid bodies and mechanical resilient elements, such as helical springs, acting on such rigid bodies and via the same on the part to be expelled. However, it is also possible and contemplated by the present invention to omit the rigid bodies and to let the resilient elements, such as springs, act directly on the part to be expelled at appropriate locations.

It is further contemplated, in accordance with a further feature of the present invention, to use means for moving the pressure plate between the lowered and raised position as a component of the expelling means. Such moving means may advantageously include at least one cylinder-and-piston unit operatable by a pressurized fluid and including a piston rod connected to the pressure plate. These cylinder-and-piston units can again be operated either pneumatically or hydraulically, depending on construction.

Advantageously, the expelling means is arranged on the machine frame upwardly of the area of the discharge opening. However, in certain cutting press constructions, only a limited amount of available space may be present at this region, or such space may be at a premium. Under these circumstances, it is advantageous when, in accordance with another facet of the present invention, the moving means includes at least two extendable driving units with different stroke lengths, on which units the pressure plate is so articulately mounted that it assumes a substantially horizontal orientation in the lowered position, and an inclined, substantially upright orientation, in front of the tool or the machine frame in the raised position. In this manner, it is possible to transfer the pressure plate immediately after the latter has moved out of its horizontal lowered position into the inclined raised or rest position, in which it occupies a much lesser amount of desirable space than if it remained horizontal even in the raised position thereof.

The central workpiece support is guided on the lateral guides or guide rails even at the curved regions of such guides. These lateral guides are being moved together with the workpiece clamping means of the coordinate table. Under these circumstances, it is possible that even the last element of the central workpiece support which is closest to the stationary support reaches a curved region of the lateral guides, when the workpiece clamping means is arranged close to the stationary support. In order to be able to horizontally support the last element of the central workpiece support and thus the cut-out part to be expelled and thus to be able to securely discharge this cut-out part after the discharge opening has been formed, even in this position of the central workpiece support, there is further provided spring means biasing the last of the louver-shaped element which is closest to the working area of the tool against the guide rails, and a cam drive carried by the lateral guide rails and operative for pivoting the last louver-shaped element into its horizontal support position against the action of the spring means. Initially, the last element is securely held in its horizontal position by the action of the spring means. When the last element reaches the curved region of the guide rails, then the cam drive arranged at the respective guide rail displaces the last element back into its horizontal position via a suitable pressing member and against the opposition of the spring means, so that the horizontal support of the workpiece and especially of the cut-out workpiece part is constantly assured, as the central workpiece support is moved toward its retracted position for releasing the discharge opening.

The novel features which are considered as characteristic of the invention are set forth in particular in the appended claims. The improved cutting press itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
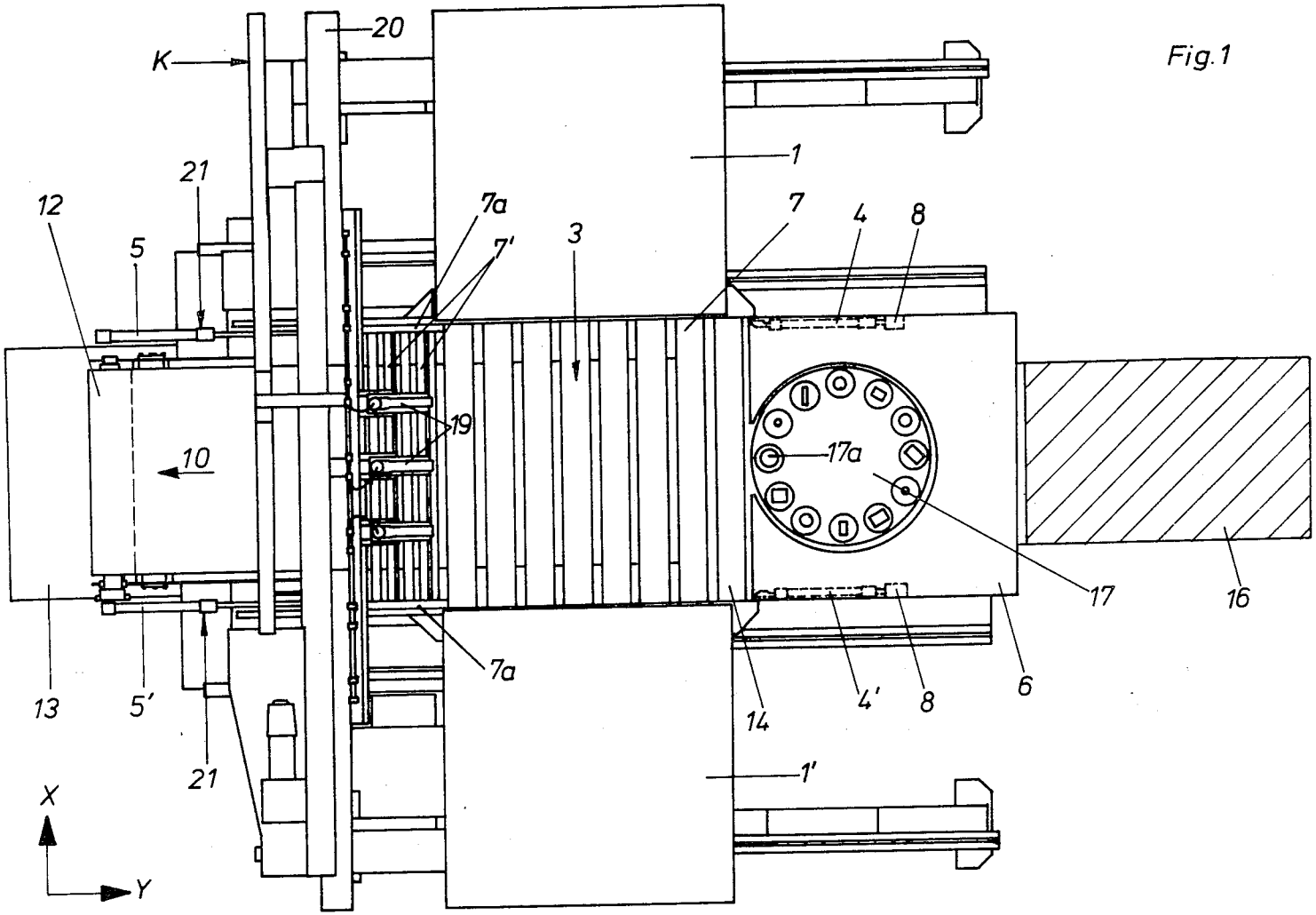
FIG. 1 is a diagrammatic top plan view of a cutting press equipped in accordance with the present invention, with a machine frame cut away upwardly of the tool operating area.

Referring now to the drawing in detail, it may be seen that a cutting press is illustrated therein in a diagrammatic and simplified manner, that is, with only such parts and components of the cutting press which are necessary for understanding the present invention being specifically illustrated. In all other respects, the cutting press is of a conventional construction, only the details disclosed herein distinguishing the same from the conventional cutting presses of the same type. The type of the cutting press illustrated in the drawing is an indexible turret cutting press that is equipped with a numerically controlled coordinate table K which is also of a conventional construction. The coordinate table K is movable in two mutually normal directions, as illustrated, along a substantially horizontal plane, these directions being indicated in FIG. 1 by coordinate arrows identified by the reference characters x and y. The y-axis indicates the directions of movement of the coordinate table K toward and away from a tool arrangement of the cutting press, whereas the x-axis indicates the movement of the coordinate table K in directions transverse to the aformentioned directions. The cutting press disclosed herein serves for working of plate or sheet shaped workpieces, especially sheet metal. In the illustrated construction, the cutting press includes an indexible turret or disk 17. The indexible turret 17 carries a tool 17*a* which is shown to be in its working position.

A stationary supporting member 6 which surrounds the working area of the tool 17*a* is provided on a diagrammatically illustrated machine frame 16. Clamping means 19 for the workpiece are arranged in a customary manner on the coordinate table K. Lateral workpiece supports 1 and 1' are mounted for joint movement in the y-direction with a guiding rail 20 for the movement in the x-direction. Frontwardly of the working area of the tool 17*a* and between the lateral supports 1 and 1', there is arranged a central workpiece support 3. The workpiece support 3 comprises support members 7 which extend transversely of the y-direction of advancement, that is, parallel to the x-direction and which are pivotably connected to one another, so that they give the central workpiece support a louvre-like construction. This central workpiece support 3, respectively the support members 7 thereof, are mounted and guided for movement relatively to the movement of the coordinate table K in suitable lateral guides 7*a*, which are here illustrated only in a diagrammatic fashion. The central workpiece support 3 is lengthened in the direction away from the tool 17*a* and beyond the support members 7 which serve the actual workpiece supporting function, by additional connecting members 7' which are articulately connected to one another, in order to assure the necessary guidance in the coordinate table.

The central workpiece support 3 is articulately connected, at its end closest to the tool 17*a*, and more particularly on last support member 14 which faces the tool 17*a*, to an actuating member, in the illustrated construction a piston rod, of each of two laterally arranged, pressurized fluid operated, cylinder-and-piston units 4 and 4'. The cylinder-and-piston units 4 and 4', in turn, are articulately connected at their respective other ends with diagrammatically illustrated connecting blocks 8 and 8', respectively. The connecting blocks 8 and 8' are mounted on the machine frame 16 or on the supporting member 6. The region of articulation of the cylinder-and-piston units 4 and 4' with the central workpiece support 3 is identified by the reference numeral 9.

The other end of the workpiece support 3 which is remote from the tool 17*a*, and more particularly the last connecting member 15, is articulately connected to piston rods of laterally arranged cylinder-and-piston units 5 and 5'. The cylinder-and-piston units 5 and 5', in turn, are mounted on the coordinate table k, as diagrammatically illustrated at 21.

Having so described the construction of the cutting press equipped with additional components in accordance with the present invention, the operation thereof will now be explained.

After the relatively large-dimensioned usable pieces or relatively large-dimensioned waste pieces have been cut out of the plate-shaped workpiece using the respective tool 17*a* provided therefor, in a customary manner, these cut-out pieces are so positioned in response to the feeding of corresponding control signals to the coordinate table K that they rest on the support members 7 or 14 of the workpiece support 3 which are close to the respective tool 17*a*. In an advantageous manner, the coordinate table K is moved at a reduced speed during this phase of the operation, in order to assure that the now loosened cut-out pieces are securely entrained for joint movement with the workpiece surrounding the same. Then, by using suitable auxiliary control function of the numerical control arrangement for controlling the movement of the coordinate table K, pressurized fluid is so admitted to the cylinder-and-piston units 5 and 5' that they cause the central workpiece support 3 to move in the direction of the arrow 10, that is, away from the range of operation of the tool 17*a*. Simultaneously with the admission of the pressurized fluid to the cylinder-and-piston units 5 and 5', the pressure of the fluid in the cylinder-and-piston units 4 and 4' is relieved, so that the operating members thereof can follow the movement of the central workpiece support 3.

A discharge opening 18 is formed between the central workpiece support 3 or the last support member 14 thereof and the end of the supporting member 6 which faces the same or the operating area of the tool 17*a* owing to this movement of the central workpiece support 3 in the direction of the arrow 10. Inasmuch as support is withdrawn in this manner from the respective cut-out piece, the latter falls downwardly through the aforementioned discharge opening 18 and is subsequently guided by a slide 11, which is arranged in a suitable manner, to a conveyor belt 12. This conveyor belt 12 transports the so discharged workpiece pieces also in the direction of the arrow 10, so that they can, for instance accumulate in a storage bin 13, as shown in FIG. 1.

Figure 2:
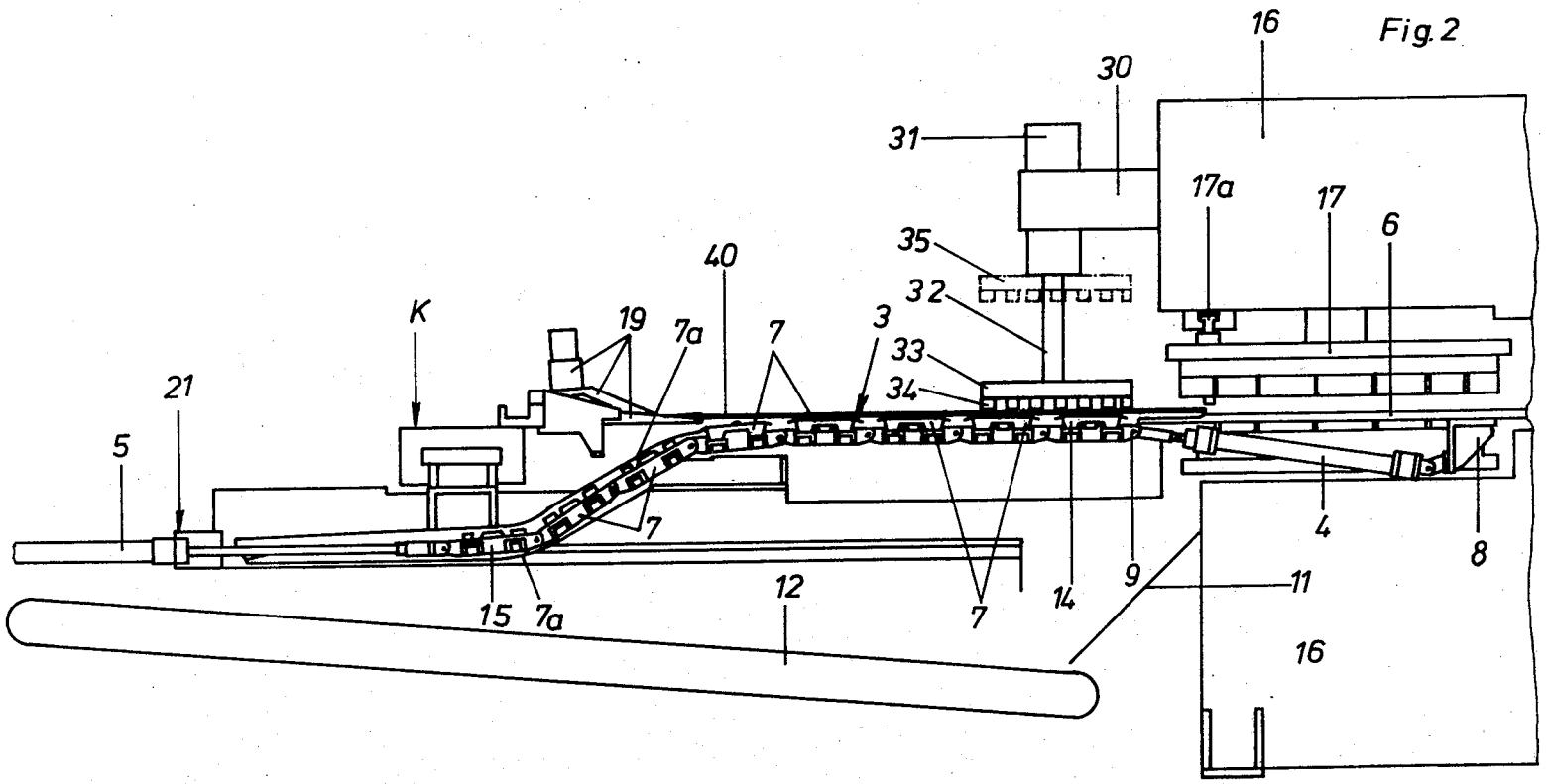
FIG. 2 is a side elevational view of the cutting press according to FIG. 1 in a closing or extended position of a central workpiece support constructed in accordance with the present invention.

Once this phase of the operation is concluded, pressurized fluid is fed to the cylinder-and-piston units 4 and 4' while the pressure of the fluid in the cylinder-and-piston units 5 and 5' is relieved, so that the central workpiece support 3 is moved toward and into the position illustrated in FIGS. 1 and 2, in which the discharge opening 18 is again cloased and the workpiece is again supported over its entire surface.

Other corresponding and suitable driving means can be also used instead of the cylinder-and-piston units 4, 4' and/or 5, 5'. Furthermore,the central workpiece support 3 can also have a different construction. What is important for the present invention is the preferably automated movability of the central support 3 for the formation of a discharge opening frontwardly of the oparating area of the respective tool 17*a*, this movability being independent of the position and advancing movement of the coordinate table K.

Figure 3:
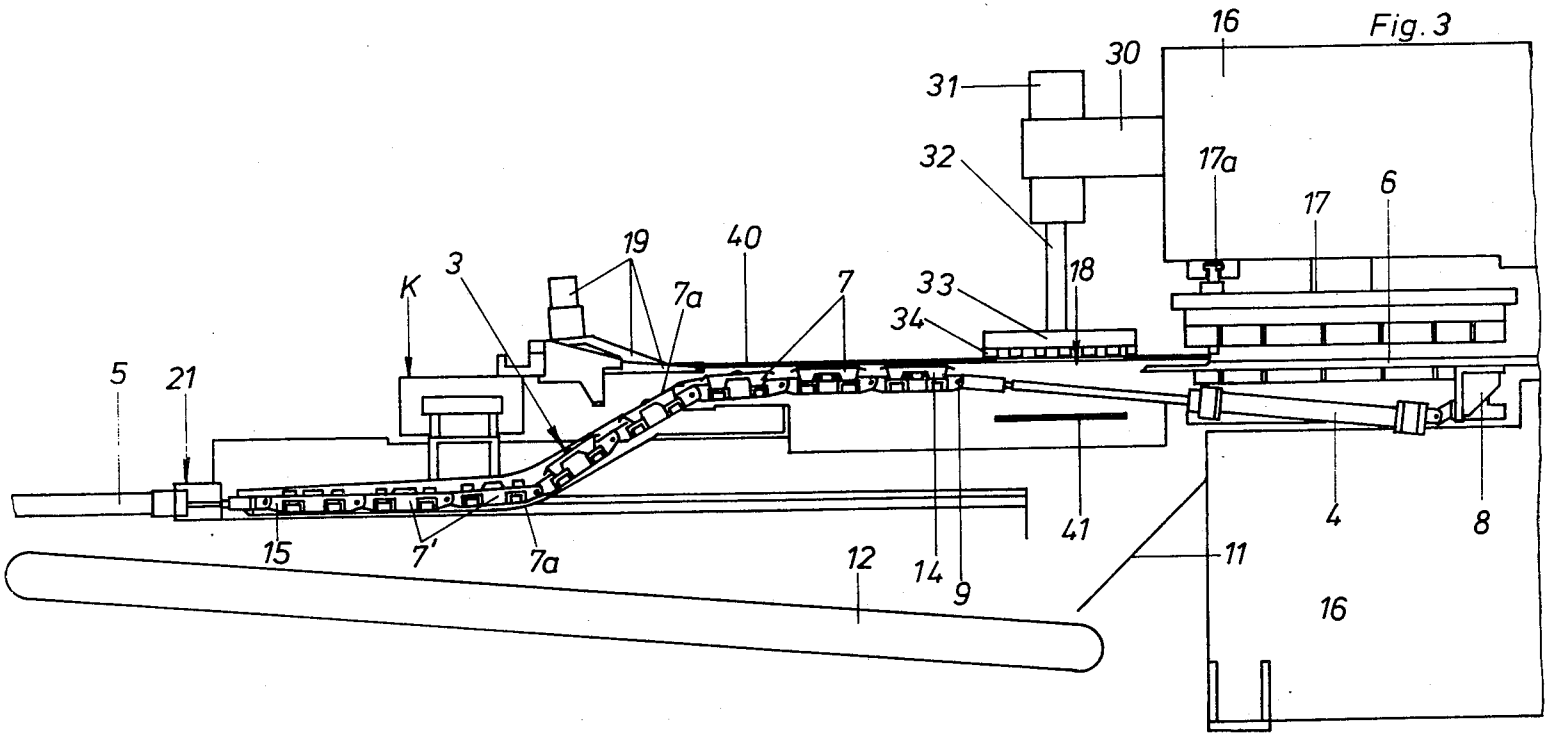
FIG. 3 is a view similar to that of FIG. 2 but with the central workpiece support in its retracted position in which it uncovers a discharge opening.

FIGS. 1 and 3 show a modified construction of the arrangement of the present invention, which is equipped with an additional pressing-out arrangement for the respectively cut out piece of the workpiece, which is to be discharged through the discharge opening freed by the central workpiece support 3. The pressing-out arrangement serves, in the manner which will be described below, for the facilitation and enhancement of the discharge of the respectively cut-out workpiece piece.

In the construction depicted in FIGS. 1 and 3, the pressing-out arrangement is constructed in the following manner: A cylinder-and-piston unit 31 is connected to the machine frame 16 with the aid of a holder 30. The cylinder-and-piston unit 31 includes a piston rod 32 which carries at its lower end a pressure plate 33 which is equipped at its lower surface with elastic pressing elements 34.

Figure 4:
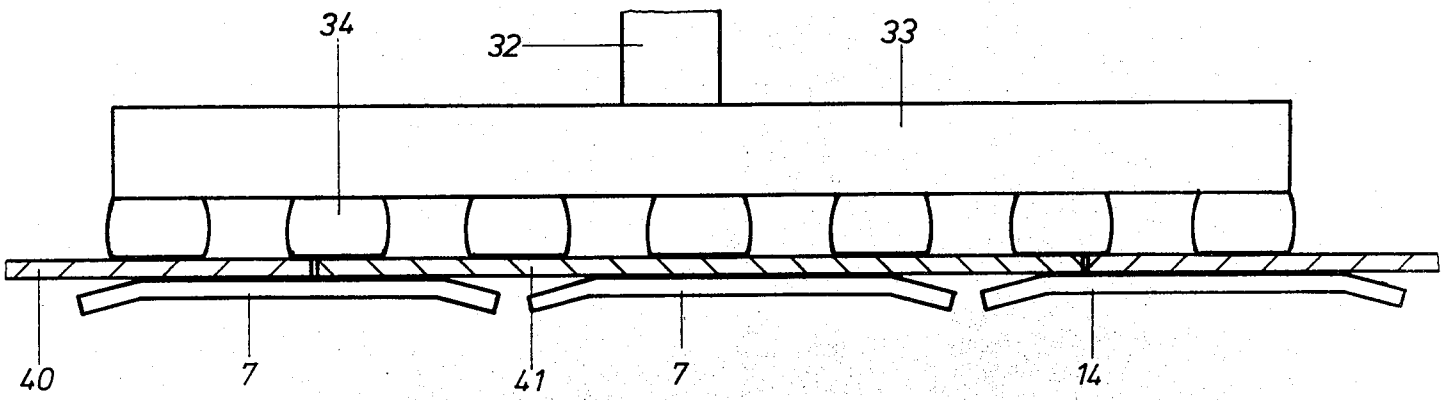
FIG. 4 is an enlarged side elevational view of an expelling part of an expelling device as acting on a fully supported workpiece.
Figure 5:
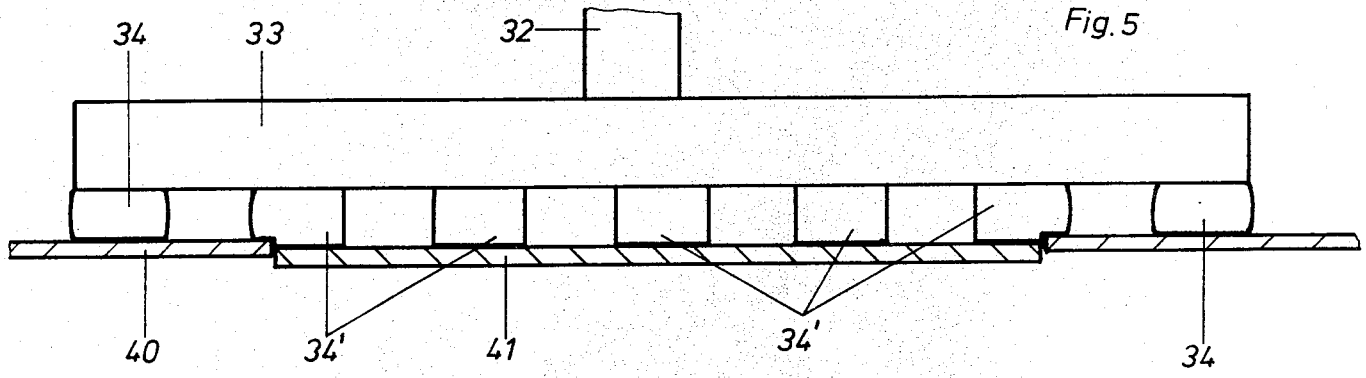
FIG. 5 is a view similar to that of FIG. 4 but after support has been withdrawn from the workpiece by retraction of the central workpiece support.

The operation of this construction, with reference especially to FIGS. 4 and 5, is as follows: As long as the cutting press or the laser cutting device operates, the pressure plate 33 assumes a position shown in FIG. 2 in dash-dotted lines and identified by the reference numeral 35. After the working of the workpiece 40 is completed, that is, after the respective piece 41 has been severed therefrom (see FIGS. 3 and 5), the workpiece 40 is retracted to such an extent that the cut-out piece 41 lies on the last support member 14 of the central workpiece support 3 or, additionally, also on one or more of the other support members 7. Thereafter, pressurized fluid is supplied to the cylinder-and-piston unit 31, so that the pressure plate 33 reaches the position that is shown in FIG. 2 in solid lines. At this time, pressure is exerted on the workpiece 40 and on the cut-out piece 41, as shown in FIG. 4. Under the influence of the pressure forces produced in the cylinder-and-piston unit 31, the pressure elements 34 obtain a substantially barrel-shaped configuration. The degree of deformation of the respective pressure element 34 into the aforementioned barrel-shaped configuration is a measure of the amount of energy stored in the respective pressing element 34.

When the central workpiece support 3 of louver-like construction is withdrawn under such circumstances, in the manner described in detail above, so that the discharge opening 18 comes into being, the pressure elements 34' (see FIG. 5) which act on the cut-out piece 41, press the latter from its previous position in the downward direction. During this process, the pressing elements 34 become unstressed and reassume their original substantially cylindrical configurations, as shown in FIG. 5.

The above-discussed pressing-out arrangement, however, can also have various other constructions. Thus, it is, for instance, conceivable and contemplated by the present invention to bring the pressure plate 33 into its pressing position by pivoting the same about a horizontal or a vertical axis.

Figure 7:
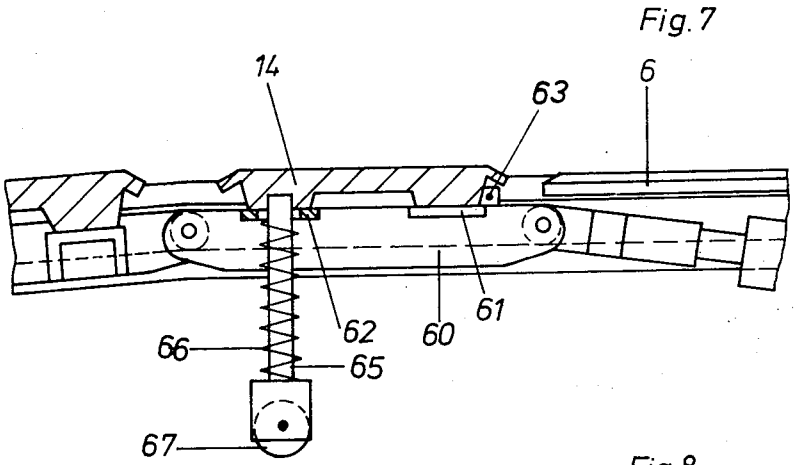
FIG. 7 is a side elevational view at an enlarged scale of the region in front of the stationary support for a first position of the last support element in its lateral guides.
Figure 8:
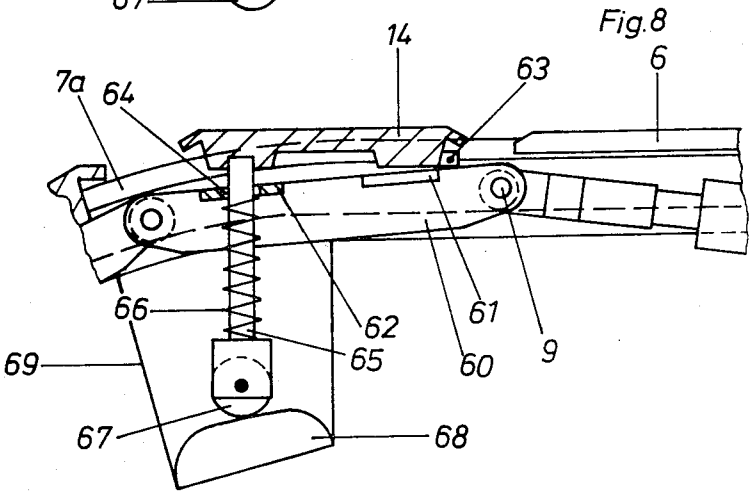
FIG. 8 is a view similar to that of FIG. 7 but with the support element in a second position in its guides.
Figure 6:
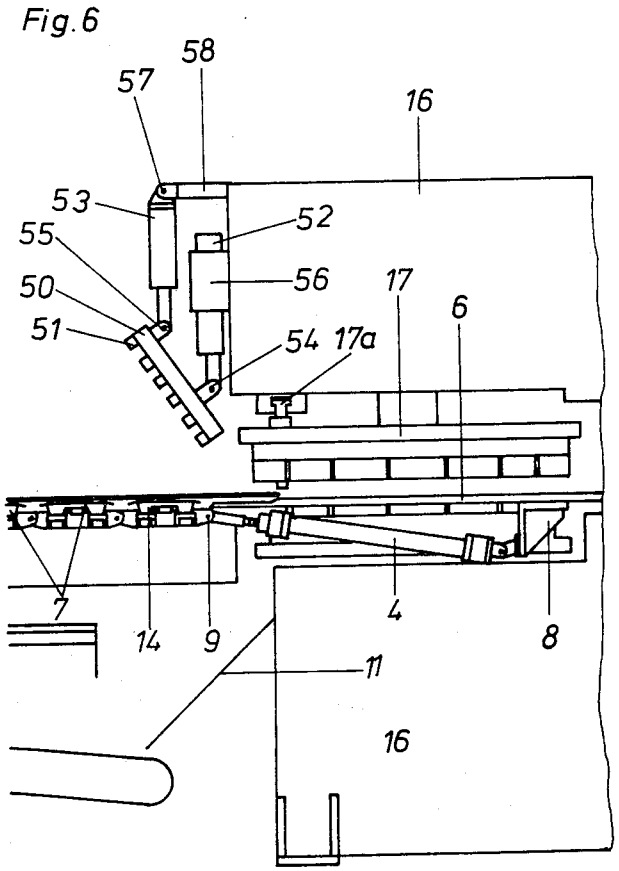
FIG. 6 is a partial diagrammatic view corresponding to that of FIG. 2 showing a modified construction of the expelling device.

When the available space in the vicinity of the tool 17*a*, that is, frontwardly of the machine frame 16, is scarce, the pressing-out arrangement can be advantageously constructed in the manner which will be described below with reference to FIGS. 6 to 8. In this construction of the pressing-out arrangement, the pressure plate, here identified by the reference numeral 50, which carries the pressing elements 51, is articulately mounted at locations 54 and 55 of two cylinder-and-piston units 52 and 53. The cylinder-and-piston units 52 and 53 permit the performance of such differently long displacements or strokes that the pressure plate 50 eventually reaches, during its downward movement, a substantially horizontal position, so that the pressing-out procedure, as described above in connection with FIGS. 4 and 5, can now take place. The cylinder-and piston unit 52 is stationarily mounted on the machine frame by means of a holder 56, whereas the cylinder-and-piston unit 53 is mounted on the machine frame 16 by means of a pivot 57 and a holder 58.

It is conceivable and contemplated by the present invention to use pressing elements 34 or 51 of various configurations, such as cross-sectionally circular, square, rectangular, or otherwise polygonal pressing elements 34 or 51. When the cut-out pieces have particularly complex configurations, the number, distribution, and shapes of the pressing elements 34 or 51 can be chosen accordingly. In this context, it is conceivable to concentrate the individual pressing elements 34 or 51 only within the outline of the cut-out piece to be removed, that is, in the illustrated construction, the cut-out piece 41, and to leave the border free of such pressing elements 34 or 51. In an alternative, there can be used only a single pressing element 34 or 51 which has a configuration corresponding to that of the piece 41 which has been cut out and which is to be removed. Advantageously, the dimensions of the pressing element 34 or 51 are slightly smaller than the corresponding dimensions of the cut-out piece 41 under such circumstances.

The secure pressing-out of the pieces 41 which have been cut out of the workpiece 40 may be dependent on the satisfaction of the condition that the witdrawal of the workpiece 40 with the cut-out piece 41 which is freely movable in the latter from the working area of the tool or of the laser beam onto the leading support elements 14 and/or 7 of the central workpiece support 3 occur in such a manner that the workpiece 40 and the cut-out piece 41 lie precisely horizontally during this witdrawal procedure. However, based on the construction of the guiding rail 7*a*, this is not always the case, especially when the workpiece clamping means 19 is situated in close proximity of and frontwardly from the supporting member 6.

The above problem is solved in accordance with the construction according to the present invention which will be discussed below in connection with the illustration contained in FIGS. 7 and 8. In order to assure the holding of the support element 14 in a horizontal position, the support element 14, in accordance with an aspect of the present invention, is not rigidly connected with or threadedly connected to the corresponding support chain link 60; rather, it is connected to the chain link 60 for pivoting about a pivot 63. The support element 14 is drawn, under normal circumstances, strongly against an underlying member 62 due to the action of a spring 66 which is arranged underneath the support element 14. However, when the workpiece clamping means 19, which are moved simultaneously and jointly with the guide rail *7a*, approach the supporting member 6, the support element 14 is so lifted by a roller 67 which runs onto and over a cam track 68 that its upper surface is horizontal. The cam track 68 is rigidly connected with the guide rail *7a* by a holder 69. The roller 67 is mounted on the lower end of a connecting rod 65 that extends through an opening provided therefor in the underlying member 62 into engagement with the support element 14. By resorting to this expedient, it is assured that the cut-out pieces 41 can be securely drawn into a position in which their pressing out or expulsion from the workpiece 40 is possible.

It will be understood that each of the elements described above, or two or more together, may also find a useful application in other types of arrangements differing from the type described above.

While the invention has been illustrated and described as embodied in a cutting press equipped with an indexible tool turret, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of my contribution to the art and, therefore, such adaptations should and are intended to be comprehended within the meaning and range of equivalence of the claims.

What is claimed as new and desired to be protected by Letters Patent is set forth in the appended claims:

1. In a machine for treating plate-shaped workpieces, especially in a cutting press, equipped with at least one tool operating within a predetermined area, a stationary support for the workpiece at such predetermined area, and a coordinate table controlledly movable toward and away from the predetermined area and operative for supporting the workpiece thereon for joint movement therewith, a combination comprising a central support for the workpiece; and means for mounting said central support on the coordinate table for movement relative thereto and independently thereof toward and away from the predetermined area between a retracted position in which a discharge opening is defined between the same and the stationary support, and an extended position in which said discharge opening is substantially closed.

2. The combination as defined in claim 1, wherein said mounting means includes a pair of lateral guide rails spaced from one another transversely of the direction of movement of the coordinate table toward and away from the predetermined area and connected to the coordinate table for joint movement therewith.

3. The combination as defined in claim 2, wherein said central support includes a plurality of substantially louver-shaped elements extending transversely of said direction, supported on said guide rails and pivotally connected in series to one another.

4. The combination as defined in claim 1, and further comprising means for moving said central support relative to the coordinate table between said retracted and extended positions, including at least one driving unit mounted on one of the coordinate table and the stationary support and acting on one end portion of said central support as considered in said direction.

5. The combination as defined in claim 4, wherein said moving means further includes at least one additional driving unit mounted on the other of the stationary support and the coordinate table and acting on the other end portion of said central support as considered in said direction.

6. The combination as defined in claim 5, wherein said driving units are cylinder-and-piston units operatable by a pressurized fluid.

7. The combination as defined in claim 5, wherein said driving units are connected to the respective ends of said central support.

8. The combination as defined in claim 1, and further comprising transportation means arranged underneath the area of said discharge opening for transporting away any objects falling thereon.

9. The combination as defined in claim 1 for use with a workpiece including at least two separate parts one of which is retained within the other; and further comprising means for expelling the one part into said discharge opening, including at least one elastic element movable between a lifted position remote from the workpiece and a lowered position in which it acts on the one part in the downward direction.

10. The combination as defined in claim 9, wherein said expelling means further includes a pressure plate connected to said elastic element for movement therewith between said raised and lowered positions and situated upwardly of said elastic element.

11. The combination as defined in claim 10, wherein said expelling means further includes means for moving said pressure plate between said lowered and raised positions.

12. The combination as defined in claim 11, wherein said moving means includes at least one cylinder-and-piston unit operatable by a pressurized fluid and including a piston rod connected to said pressure plate.

13. The combination as defined in claim 12, wherein said moving means includes at least two extendable driving units with different stroke lengths, on which the pressure plate is so articulately mounted that it assumes a substantially horizontal orientation in said lowered position and an inclined orientation in front of the tool in said raised position.

14. The combination as defined in claim 1, wherein said mounting means includes a pair of lateral guide rails spaced from one another transversely of the direction of movement of the coordinate table toward and away from the predetermined area and connected to the coordinate table for joint movement therewith; wherein said central support includes a plurality of substantially louver-shaped elements extending transversely of said direction, supported on said guide rails and pivotally connected in series to one another; and further comprising spring means biasing a least one of said louver-shaped elements which is closest to the predetermined area against said guide rails, and a cam drive carried by said lateral guide rails and operative for pivoting said last louver-shaped element into its horizontal support position against the action of said spring means.

* * * * *